United States Patent [19]

Snyder

[11] Patent Number: 4,913,008

[45] Date of Patent: Apr. 3, 1990

[54] TORQUING APPARATUS

[75] Inventor: Robert F. Snyder, Hamden, Conn.

[73] Assignee: Raymond Engineering Inc., Middletown, Conn.

[21] Appl. No.: 318,629

[22] Filed: Mar. 2, 1989

Related U.S. Application Data

[63] Continuation-in-part of Ser. No. 117,703, Nov. 5, 1987, abandoned.

[51] Int. Cl.[4] ..... B25B 13/46

[52] U.S. Cl. ..... 81/57.39; 81/58

[58] Field of Search ..... 81/57.39, 57.34, 57.33, 81/60, 476, 58; 403/344, 312; 285/367, 253; 254/160, 172, 188, 189, 224, 254 R, 254 CS; 83/414; 277/58, 218, 219

[56] References Cited

U.S. PATENT DOCUMENTS

| | | | |
|---|---|---|---|
| 2,738,243 | 3/1956 | Sawyer | 277/219 |
| 2,824,476 | 2/1958 | Wilson | 81/58 |
| 3,595,585 | 7/1971 | Bristow | 277/58 |
| 3,745,858 | 7/1973 | Biach | 81/57.39 |
| 3,872,759 | 3/1975 | Jackson | 83/414 X |
| 4,646,398 | 3/1987 | Myhrman | 403/344 X |

FOREIGN PATENT DOCUMENTS

| | | | |
|---|---|---|---|
| 23287 | 2/1907 | Sweden | 81/58 |

*Primary Examiner*—D. S. Meislin

*Attorney, Agent, or Firm*—Fishman, Dionne & Cantor

[57] ABSTRACT

A torquing apparatus is presented having a split ring which engages a member to which a torque load is to be applied. The split ring is initially loaded to establish a threshold friction load between the split ring and the member. The split ring is loaded into gripping engagement with the member during a forward (torque input) operation; and the split ring is released from the member during a return operation to achieve repeated operation without removing the apparatus from the member to be torqued.

43 Claims, 5 Drawing Sheets

TORQUING APPARATUS

CROSS-REFERENCE TO RELATED APPLICATION:

This is a continuation-in-part of U.S. Application Ser. No. 117,703 filed Nov. 5, 1987, now abandoned.

BACKGROUND OF THE INVENTION:

This invention relates to a torquing apparatus. More particularly, it relates to a torquing apparatus which is especially useful for torque wrenches and with which it is possible to deliver a series of torque inputs or loads without the need for and complications of a ratchet mechanism.

Many kinds of torque wrenches are known in the art, including manually operated wrenches and wrenches that are powered hydraulically or pneumatically. It is often desired that such wrenches be capable of delivering a sequential series of torque inputs or loads to a fastener without removing the wrench from the fastener and repositioning it each time. Such sequential operation requires some kind of ratchet mechanism (or similar mechanism) in order to recycle the wrench for each succeeding operating stroke while the wrench remains on the fastener being tightened.

While such wrenches (i.e., ratchet wrenches) are generally suitable for their intended purposes, they do have a number of problems or undesirable features. For example, the nose radius of the wrench around the output drive shaft is a critical limiting factor in determining accessability of the wrench to fasteners that are located in remote or closely confined places. Simply stated, if the nose of the wrench is bigger than the available space around the fastener, then the wrench can not be positioned to mount the output drive shaft on the fastener. In ratchet wrenches, the ratchet mechanism generally dictates the size of the nose radius of the wrench, so the ratchet becomes a limiting factor in determining the accessability of the wrench to closely confined places.

In prior art ratchet type wrenches, the ratchet also defines the minimum stroke of the wrench. As a result, it is not Possible, at least with powered wrenches, to adjust the length of the stroke at the discretion of the operator of the wrench.

In ratchet type wrenches, it is often necessary to incorporate a "no back" feature to deal with the problem of the release of wound up torque in the fastener during the return stroke of the wrench. This release of wound up torque may present an operational problem in lost motion in the wrench which may prevent the ratchet from resetting.

Ratchet type wrenches are also inherently complicated by the complications of the ratchet mechanism; and the ratchet mechanism establishes the operational load limit of the wrench because all of the torque load must be transmitted through the ratchet mechanism. Also, the cost of the wrench is increased as the requirements for complexity and sophistication of the ratchet mechanism increase.

SUMMARY OF THE INVENTION:

The above discussed and other problems of the prior art are overcome or alleviated by the torquing apparatus of the present invention. In accordance with the present invention, a torquing apparatus is disclosed which achieves the delivery of torque loads in a new way or by a new concept. The torquing apparatus of the present invention makes it possible to sequentially deliver a series of torquing inputs or loads to a fastener without the need for a ratchet mechanism, thereby eliminating many of the drawbacks caused by the presence of a ratchet mechanism. In particular, but not by way of limitation of its advantageous features, the present invention makes it possible to reduce the nose radius of the wrench to improve accessability to fasteners in closely confined places; and the apparatus of the present invention eliminates many of the problems heretofore present in ratchet mechanisms while still retaining the ability to be reset for a sequential series of torquing inputs to tighten a fastener without removing the wrench from the fastener.

In accordance with the present invention, torque is delivered to a fastener or other load by a split ring mechanism which is mounted around an output drive shaft or drive bar or other element to which a torque load is to be delivered. The following discussion will refer to the split ring mounted on an output drive shaft, but it will be understood that the split ring may be mounted on any cylindrical surface which is to be driven, or it may be mounted directly on a cylindrical portion of a fastener. An inner cylindrical surface of the split ring is mounted around an outer cylindrical surface on the output drive shaft with these two parts being in a slip fit or running fit relationship when no load is imposed on the split ring. The split ring has a spring loading mechanism which applies an initial friction load between the ring and the output drive shaft. During the forward (i.e., torque load delivery) part of the stroke of the wrench, a force is applied to reduce the gap in the split ring to thereby lock the split ring to the output drive shaft. The greater the torque load applied by the output drive shaft to a fastener being tightened, the tighter the split ring will grip and lock to the output drive shaft. On the return stroke of the wrench, a force is applied to enlarge the gap in the split ring to thereby loosen the grip of the split ring on the output rift shaft. The spring mechanism which sets the initial friction load between the split ring and the output drive shaft compresses to permit this to occur. Then, the split ring is able to slip with respect to the output drive shaft to achieve a ratchet effect (but without all of the complications and problems of a ratchet mechanism) to permit the wrench to be recycled and repositioned for another forward (torque delivery) stroke.

The torquing apparatus of the present invention makes it possible to deliver torque loads in a sequential series of strokes without removing the apparatus from the element being torqued by means of a new torquing concept which achieves the benefits of ratchet operation without the need for a ratchet mechanism and its complications.

Another feature of the wrench of the present invention is that the stroke is infinitely variable. This has potential advantages in that, e.g., a long stroke may be employed in situations where speed of operation is desired, and short strokes may be employed in situations where high accuracy in torque loading is desired. By way of contrast, ratchet wrenches do not have variable stroke capability.

The above discussed features and advantages of the present invention will be apparent to and understood by those skilled in the art from the following detailed drawings and description.

BRIEF DESCRIPTION OF THE DRAWINGS:

Referring now to the drawings, wherein like elements are numbered alike in the several FIGURES.

Figure 1:
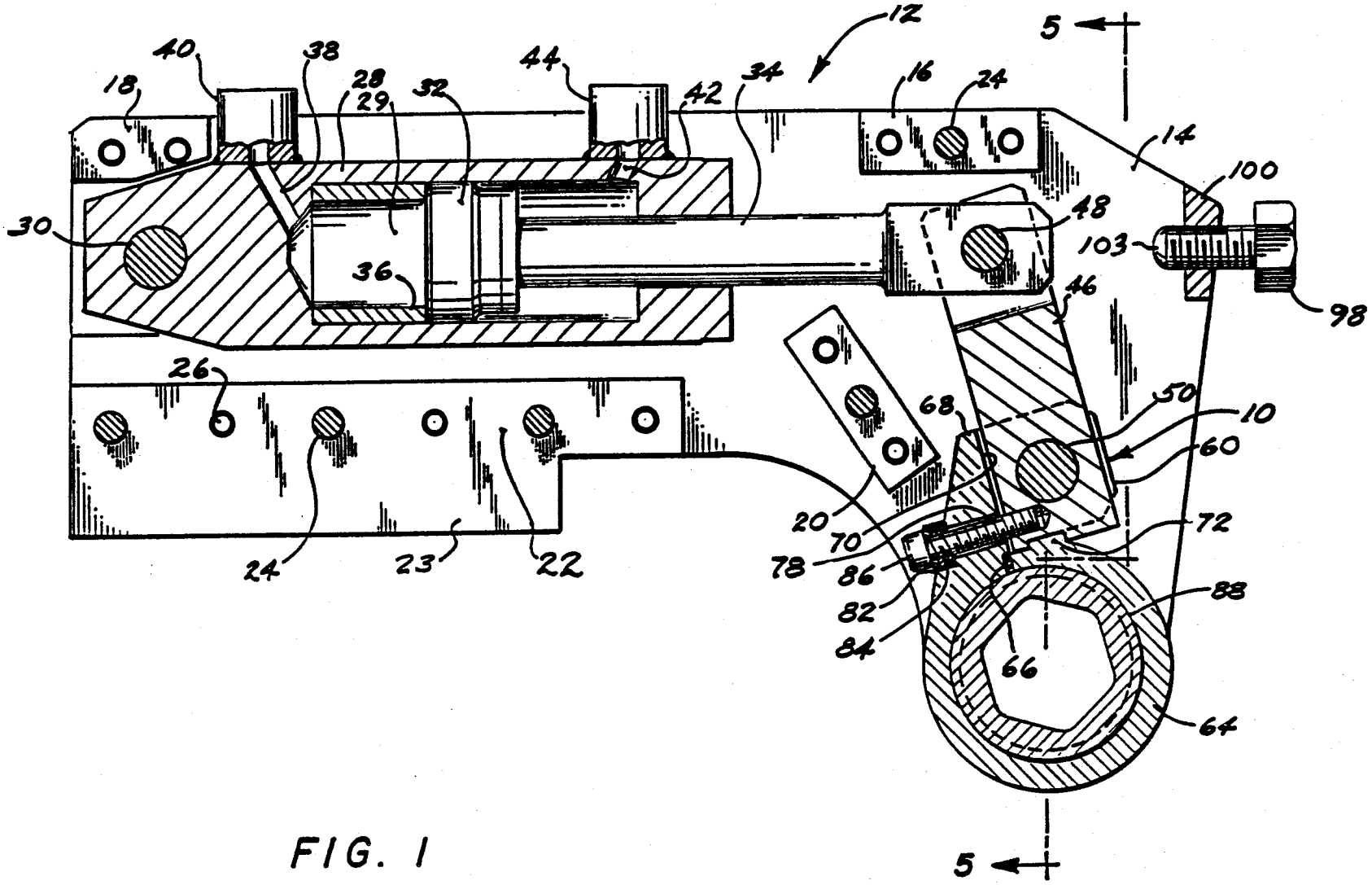
FIG. 1 is a front elevation view of the torquing apparatus of the present invention used with a hydraulically powered wrench.

DESCRIPTION OF THE PREFERRED EMBODIMENT:

Referring now to the drawing, FIG. 1 shows the general arrangement of the torquing apparatus of the present invention (indicated generally at 10) incorporated in a hydraulic wrench structure indicated generally at 12. The hydraulic wrench structure is known, per se, in the art, such as from Biach U.S. Pat. No. 3,745,858 (assigned to the assignee hereof and incorporated herein by reference). While it is generally of the type shown in Biach U.S. Pat. No. 3,745,858, the hydraulic wrench structure shown in FIG. 1 has been configured for use with the torquing apparatus of the present invention. The wrench structure has a pair of spaced apart opposed front and rear plates 14 (the top plate having been removed in FIG. 1 for purposes of explanation). The plates 14 are spaced apart by standoffs or spacers 16, 18, 20, 22. Each of the spacers is connected to the opposed plates 14 by dowels 24 and/or screw fasteners 26 extending from plates 14 into the spacers. Spacer 22 also includes a reaction plate 23 for reacting the wrench against a reaction surface.

A hydraulic cylinder 28 is pivotally mounted between plates 14 by a pivot pin 30 at one end of cylinder 28. Cylinder 28 has a piston chamber 29 in which a piston 32 is located. A piston rod 34 extends from one side of piston 32 and passes through one end of cylinder 28. A spacer 36 may be positioned at the other side of piston 32 to limit or adjust the stroke of the piston and rod. Hydraulic fluid to drive the piston and rod in the forward (torque delivery) direction is supplied to the left side of piston 32 by a passageway 38 connected to a hose connector 40 (which is, in turn, connected to a fluid supply hose, not shown). Similarly, hydraulic fluid to drive the piston and rod in the return (reset) direction is supplied to the right side of piston 32 by a passageway 42 connected to a hose connector 44 (which is, in turn, connected to a fluid supply hose, not shown). Typically when hydraulic fluid is supplied under pressure to one side of piston 32, the other side of the piston is connected to a low pressure sump or reservoir.

Figure 4:
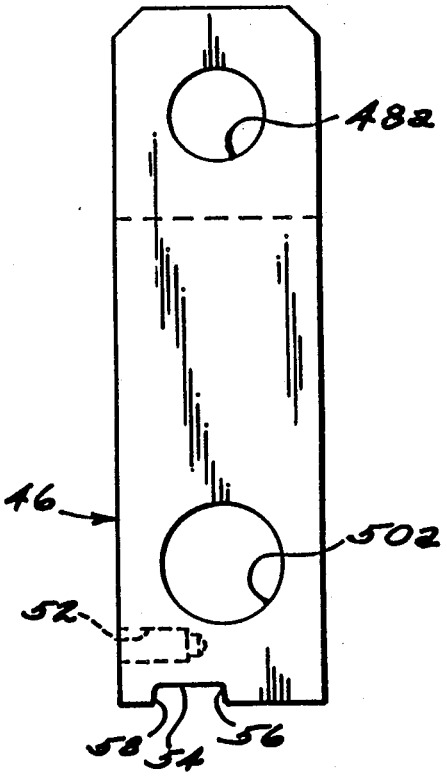
FIG. 4 is a view of the lever arm of FIG. 1.

A lever arm 46 is pivotally connected by a clevis pin 48 to piston rod 34. In the embodiment of the present invention shown in FIG. 1, the torquing apparatus 10 of this invention is connected to lever arm 46, and lever arm 46 also forms part of the torquing apparatus (as will be more fully described below). Torquing apparatus 10 is connected to lever arm 46 by a pivot pin 50. Referring to FIG. 4, the lever arm 46 is shown in detail. The right end of lever arm 46 (as shown in FIG. 4) is in the form of a clevis, and lever arm 46 has a cylindrical passageways 48(*a*) through the arms of the clevis to receive clevis pin 48. Lever arm 48 also has a cylindrical passageway 50(*a*) near the other end which receives a pivot pin 50. Lever arm 46 also has a threaded recess 52 which receives a screw which forms part of the torquing apparatus. Lever arm 46 also has at the end adjacent to passage 50(*a*) a rectangular recess 54 which defines a first shoulder 56 and a second shoulder 58.

Figure 2:
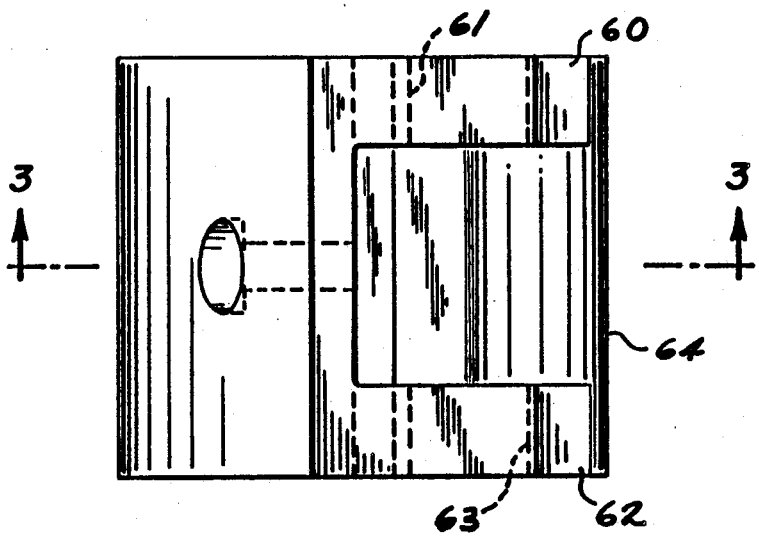
FIGS. 2 and 3 are enlarged detail views of the torquing apparatus of the present invention, FIG. 3 being taken along line 3—3 of FIG. 2.
Figure 3:
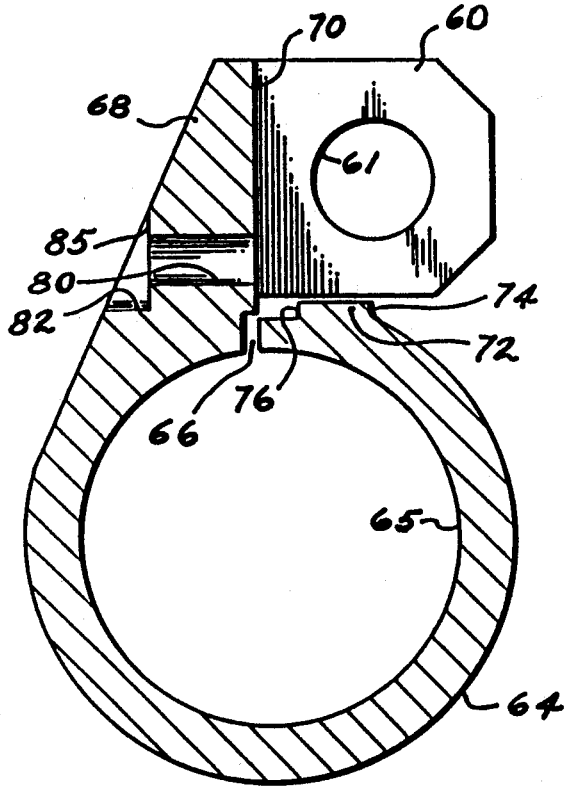
Figure 5:
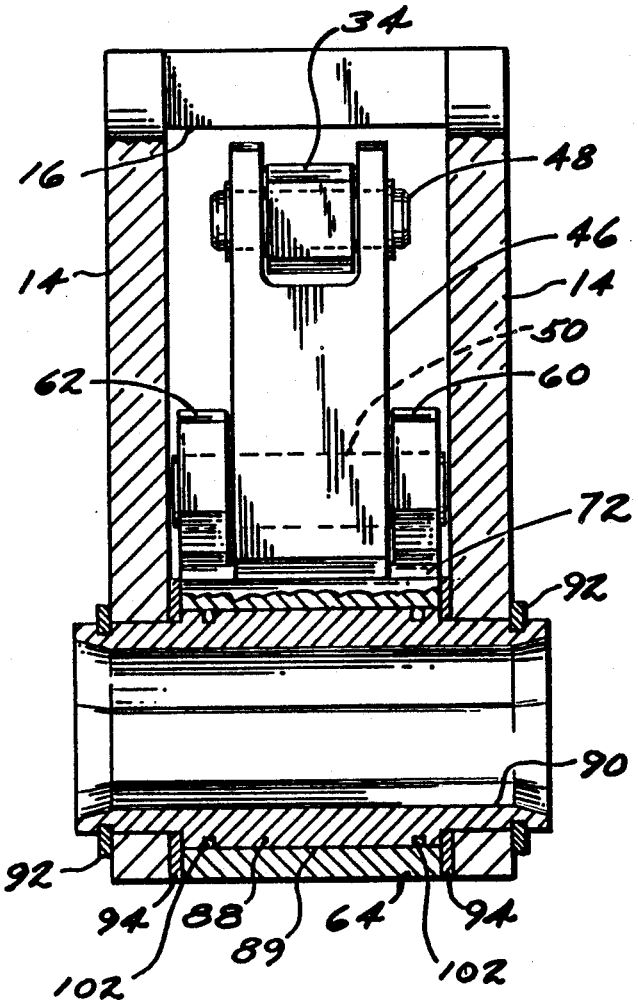
FIG. 5 is a view taken along line 5—5 of FIG. 1.

Referring now to FIGS. 1–4, and particularly to the details of FIGS. 2 and 3, the torquing apparatus is attached to lever arm 46 by a yoke or clevis consisting of plates 60 and 62 which have circular passages 61 and 63 into which pivot pin 50 is received. The plates 60 and 62 straddle lever arm 46. The torquing apparatus has a split ring 64; with the split ends being spaced apart by the spacing or gap 66. In practice, the size of gap 66 will vary depending on the diameter of split ring 64, but it is expected the spacing will typically be between 0.040 and 1.080 inches. In an embodiment made by applicant, spacing 66 was 0.063 inches for a ring of 1.594 inches ID and 2.015 inches OD. It will be noted that the gap in ring 64 is relatively small to maximize the amount of inner surface 65 of the ring which will contact and grip an output drive cylinder.

The split part of the ring is adjacent to lever arm 46. An extension member 68 projects from one part of split ring 64 and extends along a part of lever arm 46. The yoke plates 60 and 62 extend from member 68, and the bridging portion 70 between plates 60 and 62 is slightly spaced from lever arm 46 (see FIG. 1). A rectangular land 72 projects from the other part of split ring 64. Land 72 on on the split ring 64 and recess 54 on lever arm 46 are sized so that recess 54 fits over and surrounds land 72 with a slight spacing (on the order of 0.015 inches) around land 72 (see FIG. 1) so that shoulders 56 and 58 of lever arm 46 form, in effect, a slip fit against the flat sides 74 and 76 of land 72.

An adjustable screw 78 passes through slip passage 80 in extension member 68 and is threadably engaged in threaded recess 52 in lever arm 46. Thus, screw 78 is fixed relative to lever arm 46, but it is movable (slidable) relative to extension 68. Passage 80 opens into an enlarged recess or pocket 82 which houses a stack of Belleville spring washer elements 84 (or other spring means). The Belleville spring array is retained between the floor 85 of pocket 82 and the enlarged head 86 of screw 78. In the absence of any other effects, the spring array serves to urge screw 78 and lever arm 46 to the left in FIG. 1, whereby shoulder 56 of recess 54 bears against edge 74 of land 72 to urge the right side of the split, ring in a leftward direction to try to close or reduce the gap 66 in the split ring.

An output drive shaft 88 with cylindrical outer surface 89 and a hexagonal central passage 90 is positioned within the ID of split ring 64. A drive bar of hexagonal or other cross section (which mounts suitable socket elements for engaging bolt heads) will be located in hexagonal passage 90. Output shaft 88 is held in plates 14 by snap rings 92 which fit into recesses reduced end portions on the OD of the output shaft and rest against the outer surfaces of plates 14. Bronze bearings 94 are positioned between the inner surfaces of plates 14 and both split ring 64 and the main cylindrical part of output drive shaft 88 to permit smooth rotational movement of the split ring and output drive shaft relative to plates 14.

In the operation of the torquing device of this invention, the wrench will be positioned over a bolt or similar fastening element to the fastener, so that the coextensive axes of split ring 64 and output drive shaft 88 will be aligned with the axis of the fastener. The split ring and output drive shaft are sized so that in the absence of any load on the split ring, the split ring and the output drive shaft have a slip or running fit that will permit the split ring to move relative to the output drive shaft. The force of Belleville springs 84 against the screw head 86 acting through lever arm shoulder 56 and land side 74 urges the ID 65 of split ring 64 against the OD 89 of output drive shaft 88 to provide an initial frictional engagement between split ring ID 65 and the OD 89 of the output drive shaft. It is an important feature of this invention that an initial or threshhold friction load be established between the ID of split ring 64 and the OD of output drive 88. Otherwise, the split ring will slip relative to the output drive during the forward (torquing) stroke of the wrench, and the wrench will not function properly.

Pressurized hydraulic fluid is delivered to the left side of piston 32 to drive the piston and rod 34 to the right for a forward (torquing) stroke of the wrench. Rightward movement of rod 34 initially causes lever arm 46 to pivot slightly in a clockwise direction about pivot pin 50 (because the initial friction load or set between the ID of the split ring and the OD of the output drive prevents relative movement between the split ring and the output drive). The pivoting movement of lever arm 46 about pin 50 loads lever arm shoulder 56 into firmer engagement with land side 74 which thereby loads the split ring in the direction to close the gap 66 (and then slightly reduces the load on the Belleville springs). This action to reduce gap 66 causes a contraction of the inner diameter dimension of the split ring whereby the ID of the split ring is urged into firmer gripPing (locking) engagement with the OD of the output drive shaft. The split ring and output drive shaft are sized so that in the absence of any load on the split ring, the split ring and the output drive shaft have a slip or running fit that will permit the split ring to move relative to the output drive shaft. After this firm gripping engagement of the split ring with the output drive shaft has been established, continued rightward movement of piston rod 34 is transmitted through lever arm 46 to turn split ring 64 and output drive shaft 88 clockwise in unison to deliver a torque load to the fastener. It should be noted (and it is an interesting feature of this invention) that as the fastener tightens and higher torque loads are delivered to it to load it to the desired level, the loading of the ID of the split ring against the OD of the output drive shaft also increases. Thus, higher torque loads do not tend to cause slippage between the cylindrical ID of the split ring and the cylindrical OD of the output drive shaft; rather, the grip therebetween increases to prevent slippage It should also be noted that the relatively small extent of gap 66 maximizes the surface area on the ID of split ring 64 which is available for gripping engagement with the OD of output drive shaft 88 (or any other item which is engaged by the split ring).

When piston 32 and rod 34 complete their right of travel and it is desired to return the wrench to its starting position, hydraulic fluid is delivered to the right side of the piston to move it leftward for a return or resetting stroke. As rod 34 moves to the left, lever arm 46 first moves counterclockwise about the pivot pin 50 to bring lever arm shoulder 58 into contact with land side 76 whereby gap 66 is opened as the result of the right part of the split ring (with land 72) being moved away from the left part of the split ring (with extension 68). At the same time, Belleville springs 84 are compressed by the rightward movement of screw 78 relative to extension 68. This opening of gap 66 releases split ring 64 from gripping engagement with output drive shaft 88, whereby the split ring is then free to rotate relative to the output drive shaft. Continued leftward movement of rod 34 to its full retracted position then moves lever arm 46 and split ring 66 counterclockwise relative to the stationary output drive shaft (held stationary because it is on the fastener being tightened).

When the return stroke is completed (leftward movement of rod 34 stops), and the wrench is ready for another forward stroke. The Belleville springs 84 expand to move screw 78 leftward, thereby tending to slightly close gap 66 and re-establishing the threshhold friction engagement between the ID of the split ring and the OD of the output drive shaft. The unit is then ready for another forward stroke of the wrench to apply another torque load to the fastener.

Gap 66 is preferably filled with an elastomer material such as an RTV (room temperature vulcanized) elastomer. The unit also has '0' rings 102 near the bronze bearings 94. It is expected that the bearings will be lubricated; and the '0' rings 102 and elastomer in gap 66 prevent infiltration of lubricant to the OD of output drive shaft 88 and/or the ID of split ring 64 which might impair the gripping action of the split ring.

As can be seen from the foregoing, the torquing apparatus of the present invention operates in one direction to firmly engage and drive the output drive shaft to deliver a torque load to a fastener; and it operates in the other direction to move (in this case slip) relative to the stationary output drive shaft to permit the wrench to recycle for another forward stroke while the output drive shaft remains engaged with the fastener being tightened. Thus, the motion and other advantages of a ratchet mechanism are realized without the disadvantages of a ratchet mechanism.

The torquing apparatus of the present invention also has several other advantages over a ratchet mechanism. For example, a ratchet mechanism inherently defines the minimum stroke of the wrench, since the forward stroke must move the ratchet mechanism far enough to permit ratchet operation on the return stroke. No such stroke limitation is present in the torquing apparatus of the present invention. The forward stroke of the wrench can be any amount desired or selected by the operator, and the mechanism operates fully for any arc of stroke up to the maximum obtainable with the wrench. Adjustment of the stroke may be accomplished by an adjustable screw 98 housed in a block 100. The position of the rounded end 103 of the screw will set the limit of travel of piston rod 34 and, hence, set the stroke of the wrench. Thus, the wrench can be operated with full stroke, any desired short stroke, or any variation therebetween.

The elimination of a ratchet mechanism, which of necessity surrounds the output drive shaft and enlarges the nose end of the wrench, makes it possible to have a wrench with a small nose diameter. In the present invention, the nose diameter can be as small as the diameter of the output drive shaft plus the thickness of the split ring, i.e., basically the OD of the split ring. Another interesting feature of the present invention is that it is not necessary to increase the thickness of the split ring to increase the strength of the unit. Rather, strength can be increased merely by lengthening the split ring along its axis, i.e., in the direction of the axis of the output shaft. Thus, the unit can be strengthened without increasing nose size.

Since the split ring interacts with the outer cylindrical surface of the output drive shaft, the axial opening of the drive shaft can be of any cross section (e.g., hexagonal or square), and the wrench can accommodate interchangeable bits and drive bars.

The torquing apparatus of the present invention also may eliminate the need for a separate "no-back" apparatus. The wound-up torque in the fastener (which can be released on a return stroke of the wrench) will tend to maintain the friction contact between the ID of the split ring and the OD of the output drive shaft for an initial short part of the return stroke of the wrench until the stored torque in the fastener is released; and slippage of the split ring relative to the output drive shaft will start after the stored torque is released in a controlled manner. While the embodiment described herein has the screw 78 threaded (grounded) into lever arm 46, it should be understood that the screw may be grounded elsewhere. For example, the screw may be grounded by being threaded into a block carried on one or both of plates 62 or 64 or to a projection on the right side of the split ring. The essential point is that the screw must be grounded in a way that insures that the threshhold friction is applied between the ID of the split ring and the OD of the output drive shaft to cause the initial gripping therebetween for the start of the forward stroke.

It will be understood that when the foregoing discussion refers to reducing or increasing the gap in the split ring, there is an accompanying reduction or increase in the ID of split ring 64. In all cases the reduction or increase of gap and ID dimensions is very small, but those small changes are sufficient to achieve the firm gripping release actions described herein.

It should also be noted that the torquing device of the present invention is not limited to use with powered wrenches, or to wrenches in the conventional sense. The torquing unit of this invention may, e.g., be used with a manually operated wrench or a stud puller, or with any device where it is desired to apply a torque load to member in one direction and slip relative to the member in the other direction. Also, it will be understood that the split ring need not cooperate with an output drive shaft as in the embodiment described herein. The split ring may be positioned to interact (i.e., grab in one direction and slip in the other) with any cylindrical body which constitutes a load, including the member to which the torque load is to be applied. When the output drive shaft or similar structure is used, it may be viewed as an item to which the torque load is to be applied (and then delivered, e.g., to a fastener).

Figure 6:
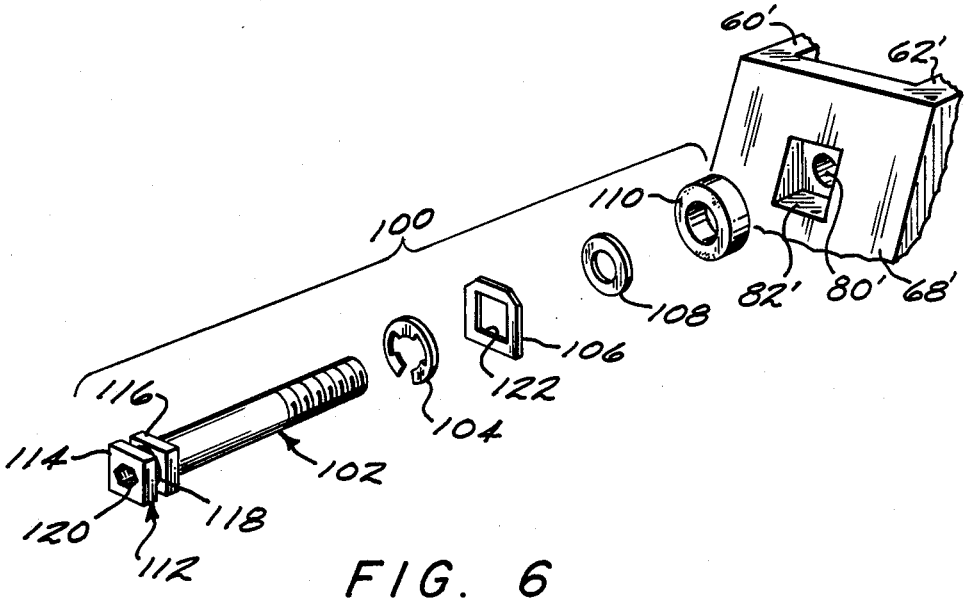
FIG. 6 is an exploded view of an alternative embodiment of the torquing apparatus of the present invention.
Figure 7:
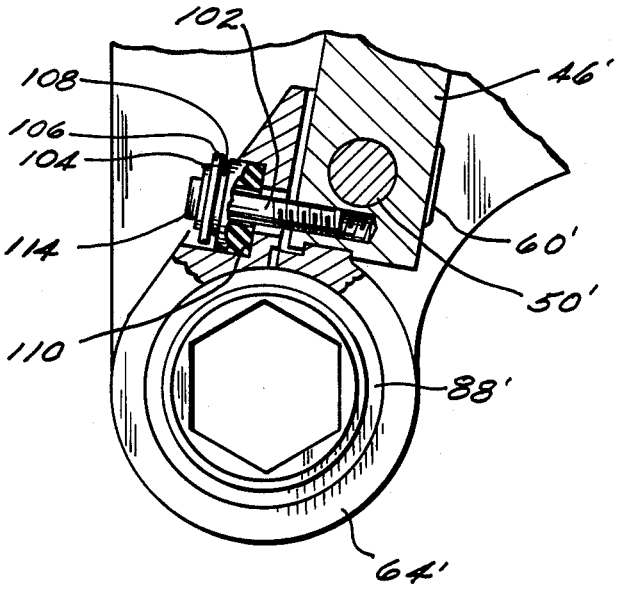
FIG. 7 is an assembled view of the torquing apparatus of FIG. 6.

Referring now to FIGS. 6 and 7, in an alternative and now preferred embodiment of the present invention, the assembly of adjustable screw 78 and Belleville springs 84 of FIG. 1 are replaced with the screw assembly 100. (All elements in FIGS. 6 and 7 which are the same as corresponding elements in FIG. 1 are identified by the identical reference numeral with the addition of a prime). Screw assembly 100 comprises a threaded screw 102, a snap ring 104, an anti-rotation plate 106, a flat metal washer 108 and a cylindrical elastomeric spring 110. Screw 102 is only partially threaded with a non-threaded surface towards its screw head 112. Screw head 112 comprises a pair of spaced square members 114 and 116 separated by a groove or slot 118. A hexagonal opening 120 in member 114 is adapted to receive a suitable hex wrench or the like.

As shown in FIG. 7, assembly 100 is received in rectangular opening 82' of the extension member 68'. When assembled, elastomeric spring 110 seats in opening 82'. Similarly, plate 106 (which also has a rectangular configuration which matches rectangular opening 82') seats in opening 82'. Screw 102 is threaded into lever arm 46' so that square member 116 is urged against washer 108 and elastomeric spring 110. At that point, member 116 will be received within opening 122 of the anti-rotation plate 106 and snap ring 104 is snapped about groove 118.

It will be appreciated that screw 102 may be adjusted in 90 degree increments (as a result of the engagement between member 116 and opening 122 of plate 106). Thus, plate 106 will not allow screw 102 to back out or loosen while snap ring 104 maintains the necessary compression exerted by the screw assembly 100.

It has now been determined that the screw assembly 100 of FIGS. 6 and 7 provides a significant improvement relative to the screw assembly of FIG. 1. In the FIG. 1 assembly, the screw 78 had a tendency to back out. In addition, screw 78 would undergo bending or even breaking due to the stresses and side loads exerted on the screw during use. In the improved embodiment of FIGS. 6 and 7, the elastomeric spring (preferably a polyurethane) will absorb much of the deleterious stresses and loads thereby allowing screw 102 to undergo the necessary reciprocating motion without breaking or bending. The use of plate 106 and snap ring 104 combines to preclude screw 102 from backout or loosening.

Figure 8:
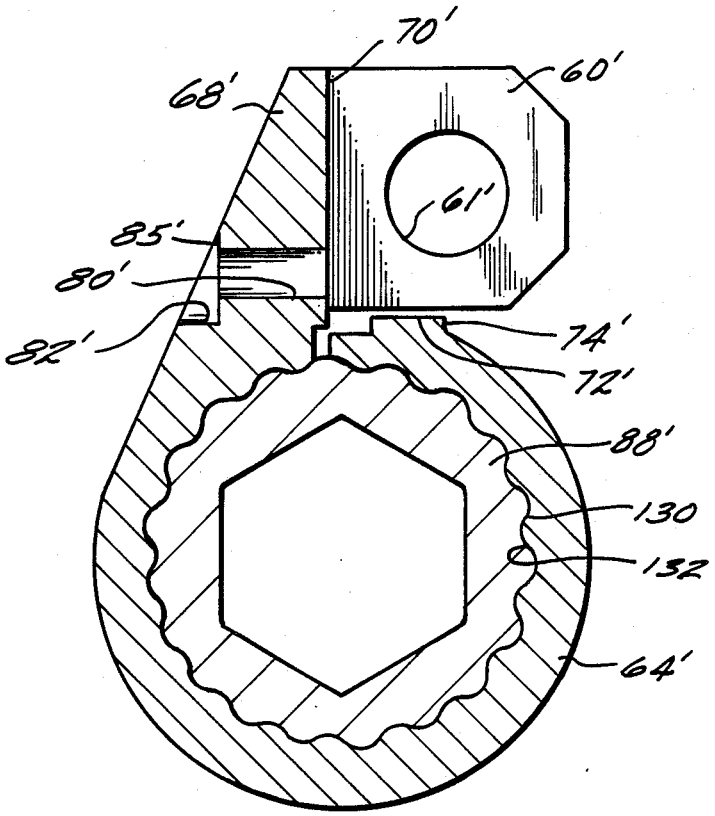
FIG. 8 is an enlarged cross-sectional view, similar to FIG. 2, depicting still another alternative embodiment of the present invention.

Still another preferred embodiment of the present invention is shown in FIG. 8. FIG. 8 is similar to FIG. 2 with similar or identical elements indicated by the same reference numerals with the addition of a prime. The primary differences between the embodiments of FIGS. 8 and 2 resides in the contacting surfaces between output drive shaft 88' and split ring 64'. Both the exterior surface 130 of output drive shaft 88 and the interior diameter surface 132 of split ring 64' have matching undulating surfaces preferably consisting of low, smooth convolutions. For the sake of simplicity, the convolutions depicted in FIG. 8 have been exaggerated in size. In a preferred embodiment, a larger number of convolutions would be utilized having a small profile or height of about 0.003 inch.

The combination of the "grabbing power" of split ring 64' and the low profile, smooth convolutions on the complimentary surfaces 130 and 132 will preclude any tendency of the output drive shaft 88' to slip while in the power stroke, while nevertheless allowing the necessary slippage while in the retract stroke. Thus, the structure of FIG. 8 offers an improvement to the structure of FIG. 2 in that the mutually smooth contact surfaces between the OD of the output device shaft 88 and the ID of the split ring 64 in the FIG. 2 embodiment was susceptable to slipping during the power stroke. The improvement of FIG. 8 is less vunerable to infiltration of oil or grease and consequently less likely to slip during the power stroke. Seals such as shown at 66 in FIG. 1 would then not be necessary in the FIG. 8 embodiment. In fact, a small amount of oil (which is undesirable in the FIG. 2 embodiment) would be helpful in the FIG. 8 embodiment so as to facilitate slippage during the retract stroke.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A torquing apparatus including:

split ring means for mounting on an item to which a torque load is to be applied, said split ring means having a gap therein and having a generally cylindrical inner opening;

adjustable load biasing means to establish an initial adjustable gripping engagement between said split ring means and the item to be torqued to prevent slippage in a first direction between said split ring means and the item to be torqued;

lever means connected to said split ring means to deliver a torque load through said split ring means to the item to be torqued;

grip enhancing means to increase the gripping engagement between said split ring means and the item to be torqued upon the delivery of increased torque to the item to be torqued; and release means to release the gripping engagement between said split ring means and the item to be torqued to permit slippage in a second direction between said split ring means and the item to be torqued, said second direction being opposite to said first direction.

2. The torquing apparatus as in claim 1 wherein said adjustable load biasing means includes:

spring means connected to said split ring means to impose a bias load on said split ring means in the direction to reduce the gap in said split ring means;

adjustable load transmission means for establishing said adjustable load biasing means, said adjustable load transmission means being operatively associated with said spring means;

said spring means being biased against a first part of said split ring means, and said load transmission means being connected to said lever means to establish said adjustable load biasing means.

3. The torquing apparatus of a claim 1 wherein said grip enhancing means includes:

means to impose a load on said split ring means in the direction to reduce the gap in said split ring means.

4. The torquing apparatus of claim 1 wherein said release means includes:

means to impose a load on said split ring means in the direction to enlarge the gap in said split ring means.

5. The torquing apparatus of claim 1 wherein:

said grip enhancing means includes interacting parts of said lever means and said split ring means to impose a load on said split ring means in the direction to reduce the gap in said split ring means; and said release means includes interacting parts of said lever means and said split ring means to impose a load on said split ring means in the direction to enlarge the gap in said split ring means.

6. The torquing apparatus of claim 1 wherein:

said adjustable load biasing means is manually adjustable.

7. The torquing apparatus of claim 2 wherein:

said adjustable load transmission means comprises a threaded fastener.

8. The torquing apparatus of claim 1 including:

sealing means to protect against infiltration of material between said split ring means and the item to be torqued.

9. The torquing apparatus of claim 7 wherein:

said spring means comprises an annular elastomeric member.

10. The torquing apparatus of claim 9 wherein said threaded fastener includes a fastener head having a pre-selected configuration and including:

an opening in said split ring means, said spring means being positioned in said opening; and an anti-rotation plate in said opening, said plate having an aperture therethrough, said aperture having a pre-selected configuration which corresponds to the pre-selected configuration of said fastener head, said anti-rotation plate cooperating with said opening to prevent said fastener head from rotating within said aperture.

11. The torquing apparatus of claim 10 wherein said fastener head includes a pair of spaced members separated by a groove and including:

a snap-ring in said groove.

12. The torquing apparatus of claim 1 wherein said inner surface of an split ring means comprises an undulating surface and including:

an output drive shaft having a generally cylindrical shape and having an undulating outer surface which matches and mates with said undulating surface of said split ring means when said output drive shaft is positioned within said split ring means.

13. The torquing apparatus of claim 12 wherein:

said undulating surfaces each comprise a plurality of smooth convolutions.

14. The torquing apparatus of claim 13 wherein:

each of said convolutions has a height of about 0.003 inch.

15. A power operated torque wrench including:

power means for generating an operating force to deliver torque to an item to be torqued;

lever means pivotally connected to said power means;

split ring means for mounting on an item to which a torque load is to be applied, said split ring means having a gap therein and having a generally cylindrical inner opening, said split ring means being connected to said lever means;

adjustable load biasing means to establish an initial adjustable gripping engagement between said split ring means and the item to be torqued to prevent slippage in a first direction between said split ring means and the item to be torqued;

said lever means being connected to said split ring means to deliver a torque load through said split ring means to the item to be torqued;

grip enhancing means to increase the gripping engagement between said split ring means and the item to be torqued upon the delivery of increased torque to the item to be torqued; and release means to release the gripping engagement between said split ring means and the item to be torqued to permit slippage in a second direction between said split ring means and the item to be torqued, said second direction being opposite to said first direction.

16. The torquing apparatus as in claim 15 wherein said adjustable load biasing means includes:

spring means connected to said split ring means to impose a bias load on said split ring means in the direction to reduce the gap in said split ring means;

adjustable load transmission means for establishing said adjustable load biasing means, said adjustable load transmission means being operatively associated with said spring means;

said spring means being biased against a first part of said split ring means, and said load transmission means being connected to said lever means to establish said adjustable load biasing means.

17. The torquing apparatus of a claim 15 wherein said grip enhancing means includes:

means to impose a load on said split ring means in the direction to reduce the gap in said split ring means.

18. The torquing apparatus of claim 15 wherein said release means includes:

means to impose a load on said split ring means in the direction to enlarge the gap in said split ring means.

19. The torquing apparatus of claim 15 wherein:

said grip enhancing means includes interacting parts of said lever means and said split ring means to impose a load on said split ring means in the direction to reduce the gap in said split ring means; and said release means includes interacting parts of said lever means and said split ring means to impose a load on said split ring means in the direction to enlarge the gap in said split ring means.

20. A power operated torque wrench as in claim 16 including:

land means projecting from said split ring means adjacent to the location of said gap;

groove means in said lever means;

said grip enhancing means including cooperating surfaces on said land means and said groove means to impose a load on said split ring means in the direction to reduce the gap in said split ring means; and said release means including cooperating surfaces on said land means and said groove means to impose a load on said split ring means in the direction to enlarge the gap in said split ring means.

21. A power operated torque wrench as in claim 16 including:

sealing means to protect against infiltration of material between said split ring means and the item to be torqued.

22. The torque wrench of claim 21 wherein:

said sealing means includes elastomer material in the gap of said split ring means.

23. The torque wrench of claim 21 wherein:

said sealing means includes ring seals between the inner surface of said split ring means and the item to be torqued.

24. The torquing apparatus of claim 13 wherein:

said adjustable load transmission means comprises a threaded fastener.

25. The torquing apparatus of claim 24 wherein:

said spring means comprises an annular elastomeric member.

26. The torquing apparatus of claim 25 wherein said threaded fastener includes a fastener head having a pre-selected configuration and including;

an opening in said split ring means, said spring means being positioned in said opening; and an anti-rotation plate in said opening, said plate having an aperture therethrough, said aperture having a pre-selected configuration which corresponds to the pre-selected configuration of said fastener head, said anti-rotation plate cooperating with said opening to prevent said fastener head from rotating within said aperture.

27. The torquing apparatus of claim 26 wherein said fastener head includes a pair of spaced members separated by a groove and including:

a snap-ring in said groove.

28. The torquing apparatus of claim 15 wherein an inner surface of said split ring means comprises an undulating surface and including:

an output drive shaft having a generally cylindrical shape and having an undulating outer surface which matches and mates with said undulating surface of said split ring means when said output drive shaft is positioned within said split ring means.

29. The torquing apparatus of claim 29 wherein:

said undulating surfaces each comprise a plurality of smooth convolutions.

30. The torquing apparatus of claim 29 wherein:

each of said convolutions has a height of about 0.003 inch.

31. A power operated torque wrench including:

power means for generating an operating force to deliver torque to an item to be torqued;

lever means pivotally connected to said power means;

split ring means for mounting on an item to which a torque load is to be applied, said split ring means having a gap therein, a generally cylindrical inner opening, projection means extending from a first part of said split ring means adjacent said gap, and land means on a second part of said split ring means adjacent said gap;

connecting means connecting said lever means to said projection means of said split ring means;

groove means in said lever means, said groove means facing and receiving said land means;

spring means biased against said projection means;

adjustable load transmission means operatively associated with said spring means to establish an initial adjustable gripping engagement between said split ring means and the item to be torqued;

first parts of each of said land means and said groove means cooperating to load said split ring means in a first direction to reduce said gap and thereby increase the gripping engagement between said split ring means and the item to be torqued in response to operation of said power means to move said lever means in a torquing direction; and second parts of each of said land means and said groove means cooperating to load said split ring means in a second direction to enlarge said gap and thereby decrease the gripping engagement between said split ring means and the item to be torqued in response to operation of said power means to move said lever means in a resetting direction.

32. The wrench of claim 31 wherein:

said adjustable load transmission means includes adjustable fastener means having one end engaging said spring means, said fastener means passing freely through said projection means and being connected to said lever means.

33. The wrench of claim 31 including:

output drive means positioned within said split ring means, said output drive means having a cylindrical outer surface facing the cylindrical inner surface of a split ring means;

the inner diameter of said split ring means without any load thereon being slightly greater than the outer diameter of said outer cylindrical surface of said output drive means.

34. A wrench as in claim 31 including:

sealing means to protect against infiltration of material between said split ring means and the item to be torqued.

35. The wrench of claim 34 wherein:

said sealing means includes elastomer material in the gap of said split ring means.

36. The wrench of claim 35 wherein:

said elastomer is RTV material.

37. The wrench of claim 34 wherein:

said sealing means includes ring seals between the inner surface of said split ring means and the item to be torqued.

38. The wrench of claim 31 wherein:

said spring means comprises an annular elastomeric member.

39. The wrench of claim 38 wherein:

said threaded fastener includes a fastener head having a pre-selected configuration and including;

an opening in said split ring means, said spring means being positioned in said opening; and an anti-rotation plate in said opening, said plate having an aperture therethrough, said aperture having a pre-selected configuration which corresponds to the pre-selected configuration of said fastener head, said anti-rotation plate cooperating with said opening to prevent said fastener head from rotating within said aperture.

40. The wrench of claim 39 wherein said fastener head includes a pair of spaced members separated by a groove and including:

a snap-ring in said groove.

41. The wrench of claim 31 wherein an inner surface of said split ring means comprises an undulating surface and including:

an output drive shaft having a generally cylindrical shape and having an undulating outer surface which matches and mates with said undulating surface of said split ring means when said output drive shaft is positioned within said split ring means.

42. The wrench of claim 41 wherein:

said undulating surfaces each comprise a plurality of smooth convolutions.

43. The wrench of claim 42 wherein:

each of said convolutions has a height of about 0.003 inch.

* * * * *